US006028302A

United States Patent [19]

Wiejak et al.

[11] Patent Number: 6,028,302

[45] Date of Patent: Feb. 22, 2000

[54] TRANSPARENT CONTAINER RELIEF INDICIAE SCANNING SYSTEM

[75] Inventors: Jean-Charles Wiejak, Villemomble; Gilles Petitpas, Montigny-le-Bretonneux, both of France

[73] Assignee: Saint-Gobain Cinematique et Controle, Gennevilliers, France

[21] Appl. No.: 08/952,961

[22] PCT Filed: Apr. 3, 1997

[86] PCT No.: PCT/FR97/00599

§ 371 Date: May 12, 1998

§ 102(e) Date: May 12, 1998

[87] PCT Pub. No.: WO97/37779

PCT Pub. Date: Oct. 16, 1997

[30] Foreign Application Priority Data

Apr. 4, 1996 [FR] France ..... 96/04233

[51] Int. Cl.[7] ..... B07C 5/34

[52] U.S. Cl. ..... 250/223 B; 250/566; 348/91; 382/142; 382/321; 209/524; 235/454

[58] Field of Search ..... 250/223 B, 223 R, 250/221.1, 221, 208.1, 208.2, 566, 568; 348/86, 91; 382/321, 322, 323, 324, 141, 142; 209/511, 522, 524; 235/454, 456

[56] References Cited

U.S. PATENT DOCUMENTS

| | | | |
|---|---|---|---|
| 3,963,918 | 6/1976 | Jensen et al. | 250/223 B |
| 4,201,338 | 5/1980 | Keller | 235/454 |
| 4,231,661 | 11/1980 | Walsh et al. | 356/340 |
| 4,250,405 | 2/1981 | Aschroft et al. | 235/456 |
| 4,521,807 | 6/1985 | Werson | 348/134 |
| 4,636,623 | 1/1987 | Martin | 235/436 |
| 4,651,879 | 3/1987 | Harris et al. | 209/523 |
| 4,668,983 | 5/1987 | Werson | 358/106 |
| 4,825,068 | 4/1989 | Suzuki et al. | 250/223 R |
| 4,990,792 | 2/1991 | Frei | 250/566 |

FOREIGN PATENT DOCUMENTS

| | | |
|---|---|---|
| 0258810 | 3/1988 | European Pat. Off. . |
| 0597178 | 5/1994 | European Pat. Off. . |
| 2354975 | 1/1978 | France . |
| 3611536 | 10/1987 | Germany . |

*Primary Examiner*—John R. Lee

*Attorney, Agent, or Firm*—Oblon, Spivak, McClelland, Maier & Neustadt, P.C.

[57] ABSTRACT

An optoelectronic system for reading reliefs, such as a mould number, on a transparent container. The optoelectronic system associates a light source and a reception system, the light source illuminating the entire periphery of part of the body of the container and the reception system being capable of reproducing a complete image of the periphery of that part of the body of the container.

6 Claims, 1 Drawing Sheet

TRANSPARENT CONTAINER RELIEF INDICIAE SCANNING SYSTEM

BACKGROUND OF THE INVENTION

1. Field of the invention

The invention relates to a device for reading reliefs on a transparent container and, more particularly, to an optoelectronic device.

2. Description of the Related Art

Although it is not limited to such an application, the invention will be more particularly described with reference to the reading of the mould number inscribed on the bottom part of the body of a glass bottle. These numbers are usually produced in the form of codes comprising points obtained by hollows produced on the internal surface of the mould or else are produced in the form of a plain-language alphanumeric code.

The invention extends, of course, to any type of transparent container and to the reading of any type of relief, in the form of hollows or bumps, which is produced in the material of which the container is made or produced from added elements such as, for example, an enamel insert, etc.

In the bottle-manufacturing industry, it is usual to carry out checks for detecting defects and/or dimensional checks. When a manufacturing anomaly is detected, it is necessary to identify the production tool, that is to say the mould used for manufacturing the bottle that has the detected anomaly. Rapid identification of the mould is preferable, in order to remedy the production defect as quickly as possible.

This code is normally read by means of optical sensors positioned on the line conveying the bottles. When the bottles move onto the conveyor they arrive in random positions; to read the mould number consequently requires the bottle to be rotated about its vertical axis in front of the sensor so that the entire periphery of the bottle moves past the sensors. The sensors can thus reproduce the image of the mould number, which makes it possible to associate the manufacturing mould with the source of the bottle. Such a device combined with a device for checking the bottle makes it possible to identify the mould responsible for any anomalies on the bottle.

Such a reading technique is described especially in U.S. Pat. 4,816,668. Although such techniques effectively allow association of a manufacturing mould with anomalies detected on a bottle, they nevertheless have various drawbacks. These drawbacks are more particularly connected with the rotation of the bottles about their vertical axis in order to bring the mould number opposite the sensor, that is to say into a reading position. The drawbacks connected with this rotation are, first of all, wear of the bottle and of the tools which rub against the said bottle in order to rotate it. Problems also arise in adjusting these tools, more particularly in the case of a manufacturing change when the next bottle does not have the same dimensions.

SUMMARY OF THE INVENTION

The subject of the invention is thus a device for reading mould numbers which does not have the afore-mentioned drawbacks and, more particularly, which does not cause wear of the bottles and which leads to a rapid result, even during a production change.

This subject is achieved according to the invention by an optoelectronic device for reading reliefs placed on the body of a transparent container associating a light source and a reception system, the light source illuminating the entire periphery of part of the body of the container and the reception system being capable of reproducing a complete image of the periphery of the said part of the body of the container.

The device according to the invention thus makes it possible, by reproducing a complete image of the periphery of that part of the body of the container on which the mould number is inscribed, to read the said number without any rotation operation. No tool therefore comes into contact with the container. There is thus no wear due to rubbing. In addition, the reading time may be greatly reduced compared with the techniques of the prior art, there being no step of rotating the container when using the device according to the invention.

Finally, in the case of a production change, the times for adjusting the device are also reduced, especially because there are no tools for performing a rotation; all that is required is to adjust the reception system so that it reproduces the image of the periphery of that part of the body of the container which bears the mould number.

According to a first embodiment variant of the device according to the invention, the reception system consists of at least two sensors. According to this variant, the sensors are combined with an electronic tool enabling a complete image of the periphery of the part of the body of the container to be reproduced from elementary images supplied by each sensor When the reception system consists of two sensors, each of the sensors preferably consists of a matrix of photoelectric diodes which is of frustoconical shape and is capable of reproducing at least the image of one half of the periphery of the part of the body of the container. According to this variant of the device, each sensor reproduces an image greater than that of one half of the periphery of the part of the body of the container so that the electronic system reproduces a complete image from these two elementary images.

If the reception system consists of four sensors, these reproduce elementary images corresponding to at least the image of one quarter of the periphery of the part of the body of the container. As previously, an electronic system is provided for reproducing a complete image.

According to another embodiment variant of the device according to the invention, the reception system consists of at least one sensor and of at least one optical operator acting on the light radiation reflected by the periphery of the said part of the body of the container.

Preferably, the reception system includes two optical operators, these being mirrors having the shape of frustoconical elements. The mirrors are then advantageously combined with a sensor which is placed above the container and which lies on its vertical axis.

Such an embodiment associating two optical operators and one sensor results in a relatively simple and compact device. The two operators may, for example, be arranged on each side of the conveyor for the container and thus do not impede the passage of the said container. Likewise, the sensor which is placed above the container does not impede its passage.

The device thus makes it possible to read the reliefs, such as a mould number, rapidly and without any contact with the container.

An electronic management system associated with the device makes it possible, for example, to then associate the observed container with its manufacturing mould. This information is subsequently stored and then used when the container is checked in order possibly to associate anomalies in the container with the manufacturing mould. The various items of information thus obtained therefore make it possible, on the one hand, to remedy the observed anomalies very rapidly and, on the other hand, to store these items of information for the purpose, for example, of producing statistics on the reliability of the moulds.

Another advantage of the device according to the invention is that, after having reproduced an image of the periphery of a part of the container, a reading of the reliefs also indicates the position of these reliefs on the image. This indication enables the orientation of the container, as it passes the relief-reading device, to be determined very simply. The orientation of the container is not normally modified at the various checking stations which come after the relief-reading device, these stations not being far away. During the checking operations it is thus possible to know the orientation of the container beforehand and thus to simplify the said checking; in fact, it is possible, for example in the case of a particular container, to omit a region of the latter since its position is established, knowing that this region would be a source of error during checking, or else to assign specific checking values for checking the said region.

BRIEF DESCRIPTION OF THE DRAWINGS

Further details and advantageous characteristics of the invention will emerge hereinbelow from the description of an illustrative embodiment of a device according to the invention with reference to FIGS. 1 and 2, which represent.

DETAILED DESCRIPTION OF THE PREFERRED EMBODIMENTS

Figure 1:
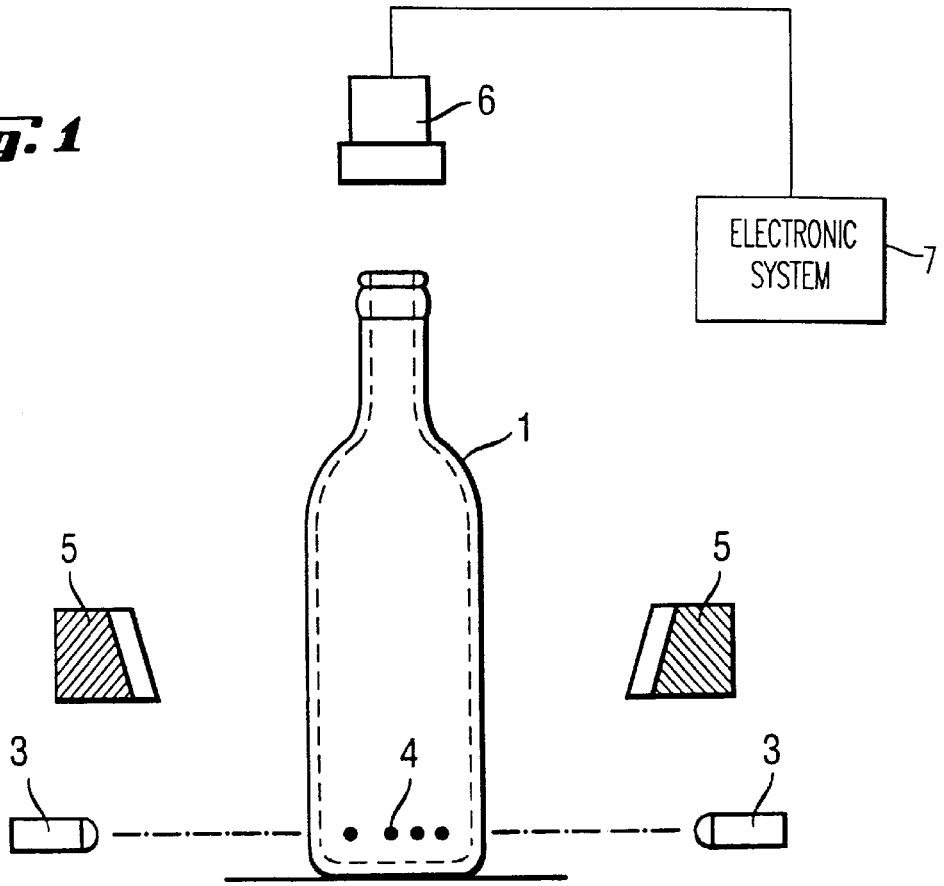
FIG. 1 a diagram of a front view of the device.
Figure 2:
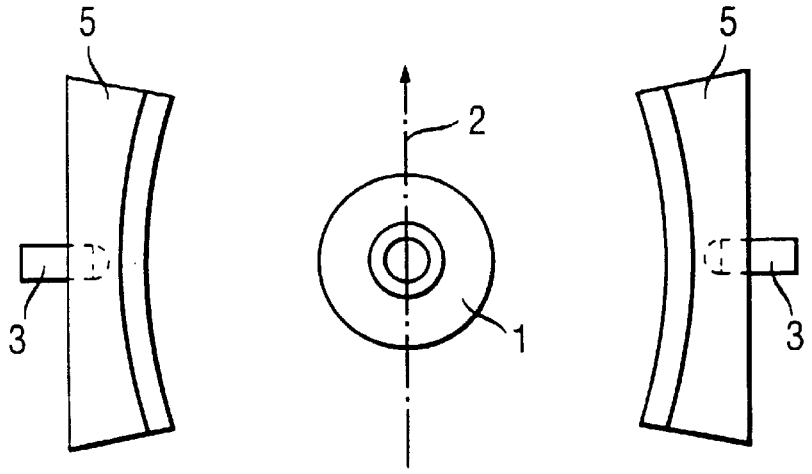
FIG. 2 a diagram of a plan view of this same device.

FIGS. 1 and 2 represent a diagram of a device for reading mould numbers which is adapted to bottles whose shape exhibits a symmetry of revolution.

A bottle 1, moving along a conveyor, not shown in the figures but represented in symbol form by the axis 2, is located in the region of the device for reading mould numbers. This is composed of a light source 3 consisting of two elements, which will be chosen by a person skilled in the art, for illuminating the entire periphery of that region of the bottle which bears the 4-point code, enabling the mould for manufacturing the said bottle 1 to be identified.

The light source 3 consists of two elements arranged on each side of the conveyor so as not to impede the travel of the bottle 1.

In the same way, arranged above are two optical operators 5, in the present case two frustoconical mirrors. The shape of these mirrors may be chosen by the person skilled in the art so that they are capable of receiving rays reflected by more than one half of the relevant region of the bottle. The position of these mirrors is also chosen so that they send these rays to the camera 6. The camera 6, combined with an electronic system 7, can thus reproduce a complete image of that region of the bottle which bears the mould number. As mentioned previously, this identification of the mould number will make it possible, in particular, to associate the bottle 1 with its manufacturing mould; since this item of information is stored, the detection of anomalies during subsequent checking operations may, for example, be rapidly resolved by carrying out work on the mould if this is the cause of it.

The example described in these figures relates to a round bottle, but the device according to the invention may be applied to all types of containers, whatever their shape; these may, for example, be containers having a square or triangular cross-section or else, for example, having shapes of the flask type. All that is then required, in order to transpose the technique presented, is for the person skilled in the art to choose the light source and the shape and position of the optical operators capable of sending the reflected rays to a camera so that the latter reproduces a complete image of the periphery of that region of the container which bears the relief or reliefs to be read.

What is claimed is:

1. An optoelectronic system for reading reliefs on a body of a transparent container comprising:

a light source; and a reception system comprising at least one sensor and at least one optical operator acting on the light radiation reflected by a periphery of a part of the body of the container;

wherein the light source illuminates the entire periphery of the part of the body and the reception system is configured to reproduce a complete image of the periphery of the part of the body.

2. The optoelectronic system according to claim 1, wherein the reception system comprises two optical operators wherein the optical operators are mirrors of frustoconical shape.

3. The optoelectronic system according to claim 2, wherein the mirrors are combined with a sensor which is placed above the container and which lies on its vertical axis.

4. The optoelectronic system according to claim 1, wherein said optoelectronic system is configured to read a mould number on a bottle.

5. The optoelectronic system according to claim 4, wherein the optoelectronic system is associated with an electronic system which is configured to identify the mould number.

6. The optoelectronic system according to claim 5, wherein the electronic system is configured to determine the orientation of the bottle.

* * * * *